US008047372B2

(12) United States Patent
Leifeld

(10) Patent No.: US 8,047,372 B2
(45) Date of Patent: Nov. 1, 2011

(54) CASE FOR RECEIVING A MEDICAMENT PACK, AND USE THEREOF

(75) Inventor: Sabine Leifeld, Berlin (DE)

(73) Assignee: Bayer Pharma AG, Berlin (DE)

( * ) Notice: Subject to any disclaimer, the term of this patent is extended or adjusted under 35 U.S.C. 154(b) by 481 days.

(21) Appl. No.: 11/478,564

(22) Filed: Jun. 30, 2006

(65) Prior Publication Data

US 2007/0017847 A1 Jan. 25, 2007

(30) Foreign Application Priority Data

Jul. 1, 2005 (DE) ..... 10 2005 032 015

(51) Int. Cl.
*B65D 83/04* (2006.01)
*B65D 85/42* (2006.01)

(52) U.S. Cl. ..... 206/534; 206/538; 206/528; 206/529; 206/532

(58) Field of Classification Search ..... 206/528, 206/529, 532, 534, 538
See application file for complete search history.

(56) References Cited

U.S. PATENT DOCUMENTS

| | | | | |
|---|---|---|---|---|
| 2,652,149 | A * | 9/1953 | O'Meara | 206/532 |
| 3,324,995 | A * | 6/1967 | Sharp, Jr. | 206/534 |
| 3,381,808 | A * | 5/1968 | McGraw, II | 206/534 |
| 3,494,322 | A * | 2/1970 | Dubbels | 206/534 |
| 3,527,190 | A * | 9/1970 | Huck | 116/308 |
| 3,579,883 | A * | 5/1971 | Hayes | 206/534 |
| 4,028,826 | A * | 6/1977 | Brandifino et al. | 40/110 |

(Continued)

FOREIGN PATENT DOCUMENTS

CH 689589 A 6/1999

(Continued)

OTHER PUBLICATIONS

Covance Pharmaceutical Packaging, "Making push-through drug packaging which is secure and safe in use uses ultrasonic welding to seal printed card to push-through pack, with data specific to use recorded on card rather than on separate medium, and optionally maching-readable for use in clinical trials, " Thomson Innovation Record View Publication date: Mar. 23, 2000: English Machine Translation of WO-00 015518.

*Primary Examiner* — J. Gregory Pickett
*Assistant Examiner* — Blaine G Neway
(74) *Attorney, Agent, or Firm* — Millen, White, Zelano & Branigan, P.C.

(57) ABSTRACT

The invention relates to a case for receiving a blister pack, comprising a first case half and a second case half. The halves are hinged on one another. The first case half is designed as a pocket for receiving the blister pack and has an outer part and an inner viewing part and also first apertures in the viewing part and second apertures in the outer part. The first apertures are at least partially aligned with the second apertures, specifically at least where the receptacles are located after the blister pack is received in the pocket. The second case half has a first compartment for receiving a first display displaying days of the week, and first windows for displaying the days of the week in an inner viewing surface of the second case half in the area of the first compartment. The first windows are arranged in such a way that they are aligned with the columns of the receptacles of a medicament pack received in the pocket.

21 Claims, 2 Drawing Sheets

U.S. PATENT DOCUMENTS

| | | | | |
|---|---|---|---|---|
| 4,974,729 | A * | 12/1990 | Steinnagel | 206/531 |
| 5,082,113 | A * | 1/1992 | Romick | 206/534 |
| 5,109,984 | A * | 5/1992 | Romick | 206/531 |
| 5,265,728 | A * | 11/1993 | Allendorf et al. | 206/534 |
| 6,273,260 | B1 * | 8/2001 | ColDepietro et al. | 206/532 |
| 6,779,663 | B1 * | 8/2004 | Pocsi | 206/534 |
| 2001/0030140 | A1 * | 10/2001 | Mundt | 206/534 |
| 2005/0178692 | A1 * | 8/2005 | Chang | 206/531 |
| 2005/0274643 | A1 * | 12/2005 | Arnold | 206/531 |

FOREIGN PATENT DOCUMENTS

| | | |
|---|---|---|
| NL | 6911920 A | 2/1970 |
| WO | WO-00/15518 | 3/2000 |
| WO | WO 01/45636 A | 6/2001 |

* cited by examiner

CASE FOR RECEIVING A MEDICAMENT PACK, AND USE THEREOF

DESCRIPTION

The present invention relates to a case for receiving a medicament pack containing receptacles arranged in columns for solid medicament portions, in particular for receiving a pack containing means used for contraception or hormone replacement therapy.

Solid medicaments are usually presented in the form of pills, coated pills, capsules, tablets and other solid presentations. Where medicaments of this kind are not supplied in a container from which they can be poured out, they can also be assembled in what are called blister packs (PTP: push-through packs). These packs generally consist of a mostly transparent plastic shell that has receiving cavities for the medicament portions, and of an aluminium foil that is welded to this shell. At the time of use, the medicament portions can be removed by pressing them out through the aluminium foil from the direction of the receiving cavity, in which process the aluminium foil tears. The receptacles formed by the individual receiving cavities hermetically seal the portions from the moment of closure to the moment of use, so that the medicaments are protected from mechanical and chemical damage. The receptacles in the blister packs are usually arranged in columns and rows. Thus, when used correctly, this provides a sequence for removal of the individual medicament portions, namely removal line by line from top left to bottom right.

Even though the blister packs are largely protected from mechanical and chemical influences by means of the medicament portions being sealed in, the medicament may still become easily impaired in daily use, for example if the receptacles are damaged by not being stored properly. It is also often desirable for the blister pack not to be recognizable to third parties as a means for holding medication. For this reason, there has been no lack of studies aimed at solving the aforementioned problems.

For this purpose, holders for the blister packs are normally used which protect the latter from damage and discreetly conceal the fact that they contain a medicament. Holders of this kind are described in, for example, DE 44 29 503 C, JP-A-2002-028 222, JP-A-2002-255 256, JP-A-2003-000 676 and JP-A-2003-012 032. These each involve cartons or folders/wallets into which the blister packs can be inserted.

A further holder for blister packs is disclosed in U.S.-A-2004/0188315. This holder for blister packs has a housing body with a first and a second plate-shaped element for receiving the blister pack between them. The first element has oblong holes through which the receiving cavities of the pack can penetrate and then emerge again. The blister pack is thus displaceable between the elements. The second element has dispensing parts which lie opposite the oblong holes and correspond to the positions of the receiving cavities of the blister pack when the latter is moved to a predetermined position. In this way, a child-proof arrangement of the pack in the holder is achieved because the tablets can then only be removed when the blister pack has reached the predetermined position in the holder.

Despite the individual receiving cavities in the blister packs being arranged in columns and rows, which ought to result in the individual medicament portions being taken correctly in an ordered sequence of administration, it has nonetheless been found that in many instances a strict administration schedule is not readily adhered to.

A first cause of this has been identified as the fact that the portions are not taken according to the prescription. It is true that a medicament package must always include directions for use. However, if the blister pack is used on its own, the directions are no longer available. In order to solve this problem, JP-A-2003-226 360 has disclosed a housing for a blister pack in which the blister pack itself and the directions for use can both be easily accommodated at the same time.

A second cause has been identified as the fact that, in many instances, a user, through lack of concentration, does not know whether a medicament portion has already been taken at a specified time or not. There is therefore a danger either of a double dose being taken within a defined period of time or of no medicament being taken at all. In many instances, treatment is seriously jeopardized by this.

To solve this problem, it has been proposed, for example in JP-A-2001-070-404 (WO 01/00135 A1), to provide a retainer for the blister pack, said retainer comprising three areas, of which a first area contains administration instructions. A second area and third area with openings arranged in a matrix formation are used to receive the blister pack between them. On at least one of the second area and third area, the dates and times of administration are assigned to the individual openings.

DE 39 05 851 A also describes a blister pack, in this instance for receiving means used for contraception, and indicating the days of the week.

A further solution to this problem is disclosed in DE 692 20 842 T. The solution chosen therein involves a holder with a support face having a planar surface and several through-openings, and with a lid articulated on the support face. The openings in the support face are arranged such that they correspond to a selected sector of tablets in a blister pack. The lid also has an edge part, which has a greater surface area than the tableted surface area on the blister pack, and an open window part, said window part having a smaller surface area then the predetermined surface area of the blister pack, but its surface area being greater than the tableted surface area. In this way, the blister pack can be arranged between the support face and the lid, and the tablets are pressed through the openings in the support face when pressure is applied to the tablets through the window. The container comprises a day calendar which can be aligned with the tablet sector in order to position a selected start day on a first tablet in the tablet sector. Near the open window, the lid also has a pointer which, after the blister pack has been positioned in the container, indicates the first tablet that is to be taken. For positioning the day calendar, a plate is provided which has a recess in which a strip showing the days, preferably a continuous loop, is arranged. The days can be seen through a slit in the edge part of the lid and can be assigned to the individual tablets in the blister pack. Moreover, this document describes a further embodiment in which a cylindrical calendar container with a cylindrical 7-day calendar is provided. Each day calendar begins with a new day and can be selectively oriented to a window. The tablets are used, for example, for contraception or hormone replacement therapy.

A similar solution is also disclosed in DE 1 909 932 A. A blister pack, containing tablets for oral contraception, is accommodated in a tablet pack with lid and base. The base comprises seven parallel rows of tablet positions in the form of openings. At the upper end of each row there is a window through which it is possible to see lettering representing a day of the week. The lettering is printed on a sheet wound round a cylinder, the days of the week extending axially along the cylinder.

Another comparable solution for indicating the days of the week is also disclosed in U.S. Pat. No. 3,530,818. The container described there comprises a blister pack of tablets, for example for oral contraception, and an integrally connected cylindrical chamber which extends parallel to the rows of tablet spaces in the medicament spaces in the blister pack, several openings in the chamber that are oriented with the spaces, and an elongate indicator tube which is arranged rotatably in the chamber and shows days of the week which extend along the axis of the tube and are located congruent with the openings in the chamber. Moreover, the blister pack comprises an indicator marker oriented with one of the openings. With the latter marker, the start of a break of five days in the administration of the tablets can be set, and the first day of renewed administration after the break and the subsequent further days of a 21-day administration period can then be automatically displayed and read off.

Some of the aforementioned holders for blister packs do satisfy the stated requirements in terms of the required safety of administration of the medicaments, by providing suitable information concerning, for example, the time of administration (date, hour), assigned to defined medicament portions. However, these holders, particularly if safe administration of the medicaments is to be ensured, are extremely complex. In some instances, expensive holders are used for the blister packs. In other instances, the display means are complicated. In WO 01/00135 A, a holder is indeed disclosed which appears to be easy to produce. However, by printing the days of the week on the holder, the latter is inflexible. The same also applies in principle to the solution according to DE 39 05 851 A.

Therefore, the object of the present invention is to make available a case which is suitable for storing a blister pack and which has the required mechanical stability and everyday user-friendliness, and which further ensures that the medicament portions held in it are safely taken in a sequence defined by the directions for use, and which additionally is very easy and inexpensive to produce.

These objects are achieved by the case according to Patent Claim 1 and by its use according to Patent Claim 21. Preferred embodiments of the invention are set forth in the dependent claims.

The case according to the invention is used for receiving a blister pack of solid medicaments, for example in the form of pills, coated pills, capsules, tablets and other solid presentations. Blister pack designates a pack for solid medicaments which has receptacles normally arranged like a matrix in columns and rows for the solid medicament portions, each of these receptacles typically containing one medicament portion. The pack is composed of at least two component parts, namely an upper and mostly transparent part made of thermoformed plastic film which has receiving cavities for the individual medicament portions, and a lower part which is mostly made of aluminium foil. After the two parts have been joined together, the medicament portions are located in the receiving cavities forming the receptacles, and they can be pushed through the aluminium foil by pressing on the receiving cavities, in which process the aluminium foil tears. Both sides can be provided with suitable inscriptions, for example details of the manufacturer and medicament and instructions for use. Examples of printed instructions for use are given in DE 692 20 842 T. The medicament portions held by the blister pack are preferably used for contraception or for hormone replacement therapy.

The case according to the invention comprises a first case half and a second case half which are hinged on one another.

The first case half is designed as a pocket for receiving the blister pack and has an outer part and an inner viewing part and also first apertures in the viewing part and second apertures in the outer part. The first apertures are at least partially aligned with the second apertures, specifically at least where the receptacles are located after the medicament pack is received in the pocket.

The second case comprises a first compartment for receiving a first display means displaying days of the week, and first windows for displaying the days of the week in an inner viewing surface of the second case half in the area of the first compartment. The first windows are arranged in such a way that they are assigned to the columns of the receptacles of a blister pack received in the pocket.

By virtue of the chosen design of the case, a blister pack can be easily accommodated in such a way as to permit clear assignment of the displayed days of the week to the columns of receptacles on the blister pack. Since the display means can be received in an exchangeable and variable manner in a suitable compartment, the blister pack can be inserted in accordance with the particular administration instructions, i.e. the first medicament portion to be taken can be assigned to the relevant day, so that portions lying alongside this are automatically assigned to subsequent days of administration.

At the same time, the case can conceivably have a simple structure, such that it can be produced inexpensively. For example, the case can be made of cardboard or plastic. All that needs to be done is to provide a corresponding pocket for receiving the blister pack and a first compartment for receiving the first display means. If the case is made of cardboard, for example, it can be suitably formed by punching, folding and adhesive bonding of the individual component parts. This can be done by mechanized means and extremely inexpensively. Despite its simple and therefore inexpensive manner of production, the case according to the invention reliably satisfies the requirements in terms of its function.

In a preferred embodiment of the invention, the second case half further comprises a second compartment and at least one second window in the area of the second compartment. The second compartment is used for receiving a second display means which displays pairs of days of the week, for example to indicate a break protocol in the administration of the medicament. The at least one second window is used for displaying these pairs of days of the week. The pair of days of the week designates, on the one hand, the day of the week on which the last medicament portion of the last administration phase was taken (stopping day of the week) and, on the other hand, the day of the week on which the first medicament portion of the next administration phase (starting day of the week) is to be taken.

If the medicament contained in the blister pack is used for contraception for example, the medicament portions are to be taken continuously at approximately 24-hour intervals during the administration phase. After typically 21 days, the administration of the medicament is discontinued. This is followed by a (break) period in which the medicament is not taken. The second display means serve to indicate the end of the period in which the medicament is not taken, so as to ensure that the first medicament portion in the next phase of administration is taken at the correct time again. For example, the period in which the medicament is not taken can amount to 7 days. The second display means show pairs of days of the week, i.e. in this instance the day of the week of the last administration in an administration phase before the break period, and the day of the week that lies 7 days after the first-mentioned day of the week. Therefore, if the day of the week of the last administration is set as the first day of the week of the pair of days of the week, the day of the week of the first administration of the next administration phase is automatically displayed as the second day of the week of the pair of days of the week. This ensures reliable renewed administration after the break period. Instead of the aforementioned periods of 21 days of administration and 7 days of non-administration, other periods may also be specified for certain contraceptives, for example an administration phase which lasts at least 24 days and at most 120 days, and a non-administration phase which in this case lasts 4 days, for example.

If the total period obtained by addition of the period of the administration phase and the period of the subsequent non-administration phase does not correspond to a multiple of a 7-day interval, the next administration phase begins on another day of the week than the last administration phase. For this reason, the first display means then has to be adjusted at the start of the next administration phase so that the first displayed day of the week corresponds to the day of the week of the displayed pair of days of the week of the second display means, indicating the first day of administration of the next administration phase. If, by contrast, the total period includes a number of days divisible by 7, the day of the week of the first day of administration of the next administration phase is identical to the day of the week of the first day of administration of the last administration phase. In this instance, the first display means can be further used without adjustment.

In a development of the invention, the first compartment is designed for insertion of the first display means and comprises a slit. Alternatively, the first compartment could be folded open and receive the first display means in the folded-open state. However, a structure in which the display means is pushed into the compartment is very easy to produce. To do so, only two layers of a suitable material are needed which are permanently connected to one another around their edges to form a compartment and which on only one side form a slit through which the display means can be pushed into the compartment.

Moreover, the slit can be open towards the articulation between the first case half and second case half. This allows the first windows for the first display means to be arranged at a short distance from the blister pack, without the display means having to be pushed deep into the compartment, for example from the opposite edge. In the latter example, handling would be made problematic because it would make exchange and renewed adjustment of the days of the week difficult. By virtue of the short distance between the windows and the blister pack, rapid and reliable allocation of the windows to the respective columns is possible. Moreover, this ensures that the display means cannot easily slip out of the case and be lost. Even if the display means were in fact not to be held firmly enough in the case, it could not fall out of the compartment when the slit is arranged in this manner.

In a further embodiment of the invention, the at least one second window is located in the inner viewing surface of the second case half. Since the first windows for the first display means are already arranged in the inner viewing surface of the second case half, the administration situation can be seen at a glance simply by folding the case open. If the second window were arranged on the outer face of the second case half, an orientation to both sides would be necessary.

In yet another embodiment of the invention, two second windows are provided, each of them showing one of the days of the week of the pair of days of the week. These windows are provided at a suitable distance from one another. If all days of the week are presented on the second display means and if one pair of days of the week can in each instance be assigned to the two second windows, the selected pair of days of the week appears automatically when the two second windows are correspondingly spaced apart from one another. This embodiment affords the possibility of a strip that shows days of the week being used to display the pairs of days of the week, which is otherwise also used as the first display means. In other words, it is not necessary to have different first and second display means. Since, in this embodiment, the second windows are in fact formed in the inner viewing surface at the desired day interval, for example a 5-day interval, the desired pair of days of the week is automatically displayed. Alternatively, the pairs of days of the week on the display means can of course also be presented in pairs one above the other or next to one another, so that the pairs then appear in a single window or in two immediately adjacent windows, for example in windows arranged next to one another or one above the other.

Where the non-administration phase can last different lengths of time, measures have to be taken to ensure that the pairs of days of the week can also be displayed automatically in the second windows under these circumstances. For this purpose, for example, the second display means used can be in the form of strips with different intervals between the days of the week, so that different day intervals are displayed in two second windows spaced apart from one another. If second display means are provided on which the pairs of days of the week are displayed directly alongside one another or one above the other, different display means present pairs of days of the week that can indicate a defined duration of a non-administration phase.

Just as the first compartment can be designed for insertion of the first display means, the second compartment can also be designed for insertion of the second display means, thereby permitting simple production. The advantages over an embodiment that can be folded open have already been described in respect of the first compartment. The second compartment has an insert opening for the second display means. The insert opening can in particular be open towards an outer edge of the second case half. In this way, this compartment can be easily accessed for insertion or removal of the display means. To further simplify handling, the insert opening can also have a grip recess.

The first and second display means can preferably be designed in the form of strips, namely in the form of a strip showing the days of the week, and an information strip for the pairs of days of the week. This ensures simple production. The strips can be made, for example, of paper, cardboard, plastic or metal, and of composite materials of paper, cardboard, plastic or metal (filled for example with reinforcements for strengthening them, in particular fibres), or of composites of these with other materials, or also of laminates of these materials.

Use is made much easier by formation of folds in the strips, so that these strips are divided into sectors on which the days of the week or pairs of days of the week are presented. In this way, the strips can be adjusted to the desired day of the week. The strip used as the first display means can, for example, include a series of 13 days of the week, for instance starting from Su (Sunday) through Mo, Tu, We, Th, Fr, Sa, Su, Mo, Tu, We, Th and Fr, so that all conceivable series of days of a week, starting with any desired day of the week, can be formed by folding the strips at the folds. A days of the week strip that has been folded in this way can then be pushed into the first compartment and shows the administration days, starting with the selected first day of the week. The information strip used as the second display means can be formed like the aforementioned days of the week strip; when forming the pair of days of the week, account must be taken of which break period is to be displayed.

For easier handling of the first display means, it can have a holding tab on one of the longitudinal edges. In this way, for example, a strip can be more easily pushed into the first compartment and then removed from it again.

The blister pack is received in the pocket in the first case half. Just like the first compartment and second compartment, the pocket can also be designed such that the blister pack can be pushed into it. For this purpose, the pocket has an insert opening. The insert opening on the pocket can, like the first compartment, be open towards the articulation between the first case half and second case half. The advantages arising from these embodiments are the same as in the case of the insert compartments.

The pocket is preferably designed such that the pack received by it engages immovably in the pocket. This considerably facilitates handling. In particular, this prevents the blister pack from slipping within the pocket and leading to the loss of the assignment between the days of the week displayed in the first windows and the receptacles of the blister pack. This would greatly compromise the safety of administration.

In order to maintain sufficient stability of the case even when the latter is used after frequent exchange of finished blister packs, the first and/or second apertures can be oblong holes. If the case and thus the pocket were made of relatively stable material, for example thick cardboard or stable plastic, and if the circle diameter of the apertures were so small that the receptacles of the blister pack could just protrude into them, insertion of the blister pack would be difficult if the pocket was at the same time made so narrow that the blister pack could as far as possible no longer be displaceable therein. To ensure that in such an eventuality the blister pack can still be inserted fairly easily into the pocket, at least the apertures in the inner viewing part can be designed as oblong holes through which the receptacles of the blister pack are intended to protrude. In this way, the blister pack is as it were guided upon insertion into the pocket, because the receptacles slide into the oblong holes. For this purpose, the oblong holes preferably extend along the columns of receptacles.

To ensure that the blister pack also engages immovably upon insertion into the pocket, the receptacles are preferably in the form of raised domes which, after the blister pack is received in the pocket, protrude into the oblong holes and through them, and the oblong holes are exactly as long as the columns of receptacles on the blister pack. After the pack has been inserted, all the receptacles protrude into the oblong holes. Because of the uniformity of the lengths of the oblong holes and of the columns of receptacles, there is no longer any play, and the pack sits immovably in the pocket.

The case can be made of any desired materials, for example of paper, cardboard, plastic or metal, and of composites of paper, cardboard, plastic or metal, or of composites of these with other materials, or also of laminates of these materials.

To protect the case, and to permit an attractive and discreet design, the case can additionally be inserted into a slipcase that can be made of one of the aforementioned materials.

The invention is explained in more detail with reference to the attached figures, in which.

Identical reference numbers designate the same features in all the figures.

Figure 1:
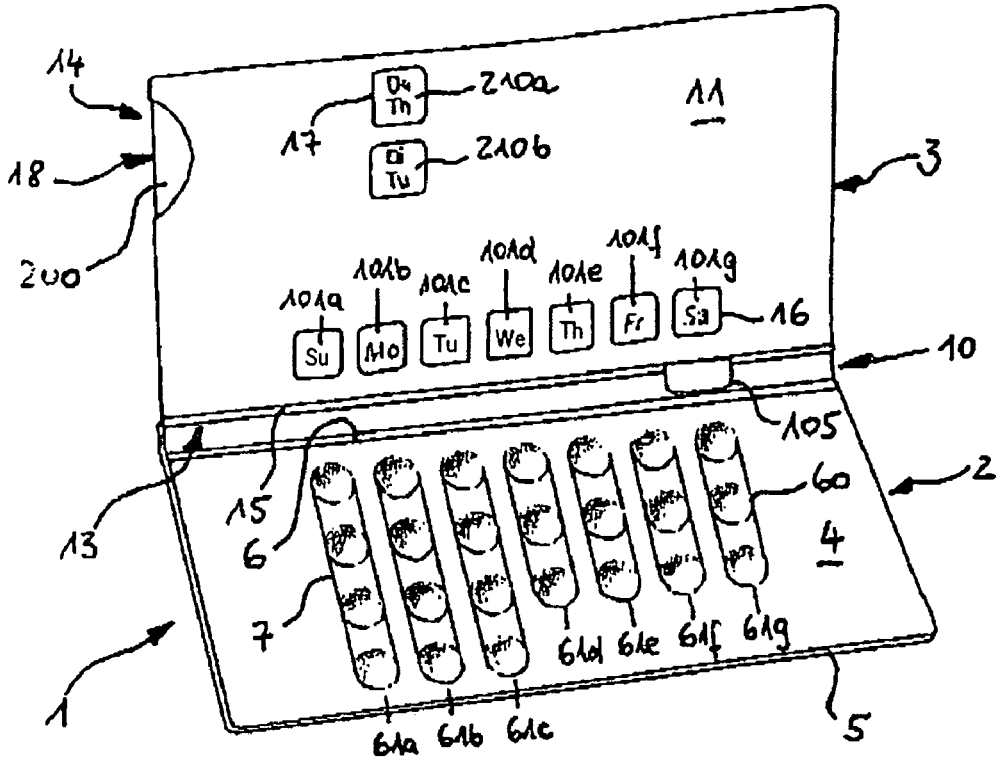
FIG. 1 shows a perspective view of a case with a display for the days of the week, and a display for a pair of days of the week.

In FIG. 1, a case 1 according to the invention is shown which comprises a first case half 2 and a second case half 3. The first case half and second case half are hinged on one another via an articulation 10.

The first case half 2 is formed by an inner viewing part 4 and an outer part 5. Both parts are connected to one another permanently, for example by adhesive applied around the edges. An insert opening 6 between the inner viewing part and the outer part opens out towards the articulation 10 and forms the access to a pocket for a blister pack. The pack comprises raised receptacles 60 that contain tablets or other solid presentations of a medicament. The blister pack can be pushed through the insert opening into the gap which is situated between the inner viewing part and the outer part and which forms the pocket. In doing this, the receptacles of the blister pack slide into the oblong holes 7 formed in the inner viewing part. The oblong holes are formed in the inner viewing part in a pattern corresponding to the columns 61*a*, 61*b*, 61*c*, 61*d*, 61*e*, 61*f*, 61*g* in which the receptacles are received on the blister pack, so that all the receptacles can engage with a precise fit in these holes. The blister pack has seven columns corresponding to the seven days of the week. Since the blister pack contains 24 receptacles, there are four receptacles each in three of the seven oblong holes corresponding to the columns 61*a*, 61*b*, 61*c*, and three receptacles each in four oblong holes corresponding to columns 61*d*, 61*e*, 61*f*, 61*g*. The length of the oblong holes is adapted accordingly. In the outer part too, holes are formed (not shown here) at the locations where the receptacles of the blister pack are positioned. Thus, by pressing on the receptacle, a tablet located in a receptacle can be pressed through a lower aluminium foil, which closes off the bottom of the receptacle, and out through these lower holes.

Like the first case half 2, the second case half 3 is made up of two parts. The first part forms an inner viewing surface 11. The second part forms an outer surface (not shown). The two parts are connected to one another permanently, for example by adhesive bonding. A first compartment 13 and a second compartment 14 are formed between the first part and the second part. The first compartment is accessible via a slit 15 which is open towards the articulation 10. A strip showing the days of the week can be pushed in through this slit.

For easier handling, this strip has a holding tab 105. Days of the week 101*a*, 101*b*, 101*c*, 101*d*, 101*e*, 101*f*, 101*g* on the strip are displayed through first windows 16. The first windows 16 are assigned to the columns 61*a*, 61*b*, 61*c*, 61*d*, 61*e*, 61*f*, 61*g*. In the inner viewing surface, second windows 17 are also formed through which displayed pairs of days of the week 210*a*, 210*b* can be seen. These pairs of days of the week are located on an information strip 200 which can be pushed into the second compartment through an insert opening 18.

Figure 2:
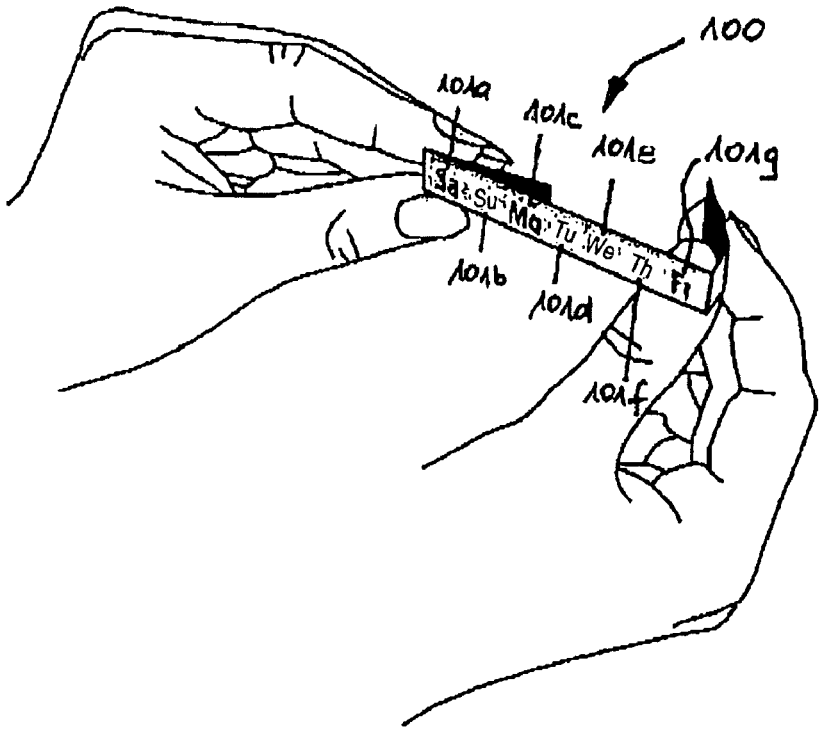
FIG. 2 shows a view of someone preparing the strip indicating the days of the week.

FIG. 2 shows a first display means in the form of a strip 100 indicating the days of the week. Days of the week 101*a*, 101*b*, 101*c*, 101*d*, 101*e*, 101*f*, 101*g* are displayed on this strip. If, after a period during which the medicament is not taken, the first day that administration is to be resumed is a Saturday, that part of the strip lying to the left of the sector with the letters "Sa" is folded back. The same thing is done with that part of the strip lying to the right of the sector with the letters "Fr".

Figure 3:
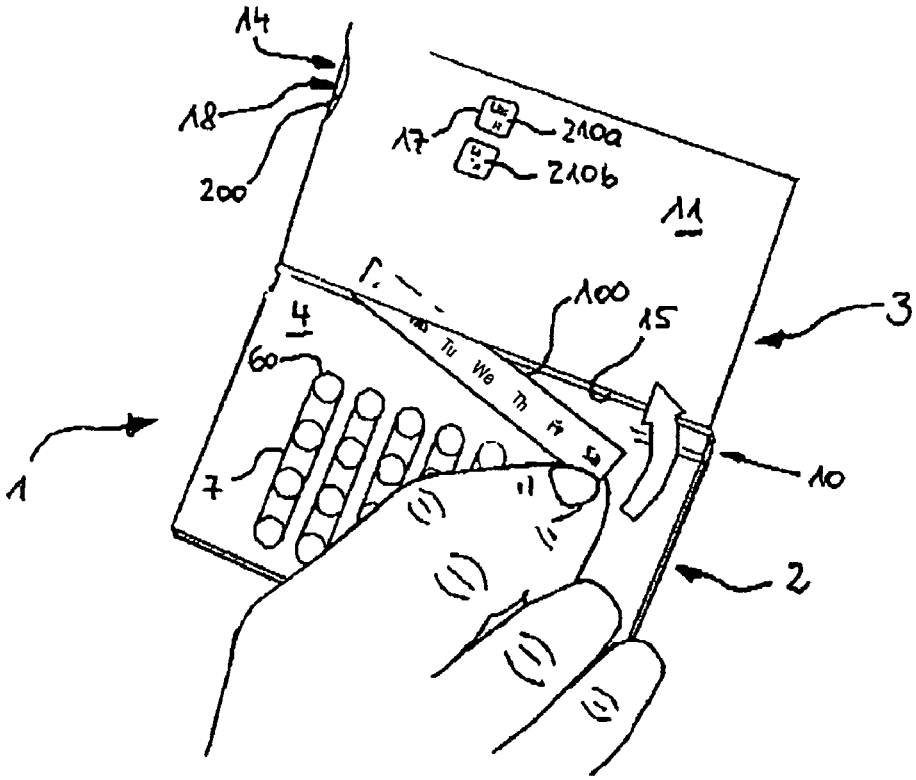
FIG. 3 shows a view in which a strip indicating the days of the week is being pushed into the first compartment.

As is shown in FIG. 3, a days of the week strip 100 that has been prepared in this way can be inserted through the slit 15 into the second compartment in the second case half 3.

Figure 4:
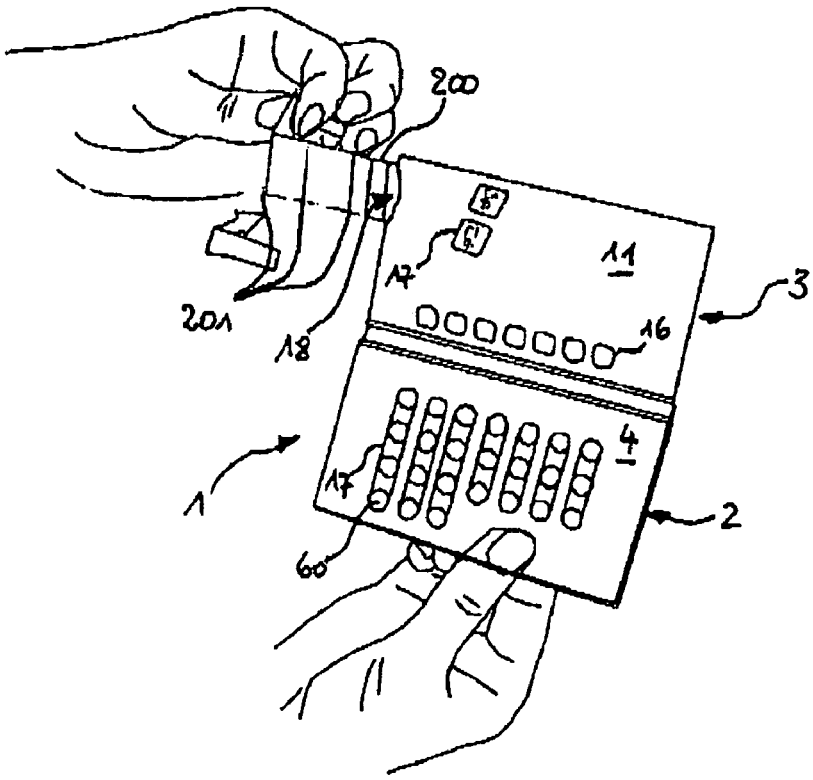
FIG. 4 shows a view in which an information strip indicating a pair of days of the week is being inserted.

As is shown in FIG. 4, the information strip 200 is a single strip that can be inserted from the left into the second compartment via the insert opening 18. To place this strip in the correct position behind the second windows 17, i.e. to show the correct pair of days of the week 210*a* and 210*b* in both of the second windows, folds 201 are provided in the information strip and, as is shown, these are used for folding the strip back at the correct place. Since the information strip can then be inserted into the second compartment only until it ends flush with the left-hand outer edge of the case half, the desired pair of days of the week 210*a* and 210*b* appears in the windows 17. After suitable preparation, the pair of days of the week 210*a* and 210*b* appearing in the second window 17 indicates the last day of administration in a first sector and automatically indicates the first day of administration of the next administration phase in a second sector.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

The entire disclosure of all applications, patents and publications, cited herein and of corresponding German application No. 10 2005 032 015.5, filed Jun. 1, 2005, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Case in combination with a medicament pack containing receptacles arranged in columns for solid medicament portions, said case comprising a first case half and a second case half which are hinged on one another, where a) the first case half i. is designed as a pocket receiving the medicament pack and ii. has an outer part and an inner viewing part and also first apertures in the viewing part and second apertures in the outer part, the first apertures being at least partially aligned with the second apertures, specifically at least where the receptacles are located after the medicament pack is received in the pocket, and b) the second case half has:

i. a first compartment (13) for receiving a first display means displaying days of the week (101*a*-101*g*), and ii. first windows (16) for displaying the days of the week (101*a*-101*g*) in an inner viewing surface (11) of the second case half in the area of the first compartment, the first windows being arranged in such a way that they are aligned with the columns of the receptacles of a medicament pack received in the pocket with each day being assigned to a separate column, and c) a second compartment (14) receiving a second display means (200) in the form of a single strip that comprises pairs (210*a* and 210*b*) of days of the week, each pair being indicative of a break period in the administration of the medicament, and each pair having a stopping day of the week and a starting day of the week with a single pair being disposed in at least one second window (17) in the area of the second compartment (14) whereby a patient is informed on the case (1) of the starting and stopping days defining the break in administration of the medicament.

2. Case according to claim 1, characterized in that the medicament pack can be engaged immovably in the pocket.

3. Case according to claim 1, characterized in that the first and at least one of second apertures are oblong holes.

4. Case according to claim 3, characterized in that the oblong holes extend along the columns of the receptacles.

5. Case according to claim 3, characterized in that the receptacles are raised domes which, after the medicament pack is received in the pocket, protrude into the oblong holes or through them, and in that the oblong holes are exactly as long as the columns of the receptacles.

6. Case according to claim 1, characterized in that the pocket is designed for insertion of the medicament pack and has an insert opening.

7. Case according to claim 6, characterized in that the insert opening is open towards an articulation between the first case half and second case half.

8. Case according to claim 1, characterized in that the first compartment is designed for insertion of the first display means and comprises a slit.

9. Case according to claim 8, characterized in that the slit is open towards an articulation between the first case half and second case half.

10. Case according to claim 1, characterized in that the at least one second window is located in the inner viewing surface of the second case half.

11. Case according to claim 1, characterized in that two second windows are provided, each showing a respective day of the week of the pairs of days of the week.

12. Case according to claim 1, characterized in that the second compartment is designed for insertion of the second display means and has an insert opening.

13. Case according to claim 12, characterized in that the insert opening is open towards an outer edge of the second case half.

14. Case according to claim 12, characterized in that the insert opening has a grip recess.

15. Case according to claim 1, characterized in that at least one of the first and second display means is configured as a strip.

16. Case according to claim 1, characterized in that the strip is divided by folds into sectors on which the days of the week or pairs of days of the week are displayed.

17. Case according to claim 16, characterized in that the first display means has a holding tab on one of its longitudinal edges.

18. Case according to claim 1, characterized in that the medicament pack has 24 receptacles.

19. The case according to claim 1 wherein the medicament pack contains medication for contraception or hormone replacement therapy.

20. The case of claim 19, wherein the solid medicament portions are twenty four tablets arranged in seven columns and four rows, the tablet which is a starting tablet being associated with the start day in a first row and first column and the tablet which is a stop tablet being associated with a stop day in the fourth row and wherein the first display means is a strip having thirteen days of the week, each day alignable with one of the first windows and wherein the second display means is a second strip having days of the week in selected intervals according to the break protocol of the dosing regimen.

21. The case of claim 20, wherein the break protocol is four to seven days.

* * * * *